United States Patent [19]

Nissl et al.

[11] Patent Number: 5,003,884

[45] Date of Patent: Apr. 2, 1991

[54] HOLLOW OR PROJECTILE CHARGE

[75] Inventors: Norbert Nissl; Peter Grössler, both of Schrobenhausen, Fed. Rep. of Germany

[73] Assignee: Messerschmitt-Bölkow-Blohm Gesellschaft mit beschränkter Haftung

[21] Appl. No.: 633,784

[22] Filed: May 24, 1984

[30] Foreign Application Priority Data

Jun. 10, 1983 [DE] Fed. Rep. of Germany ..... 3321035

[51] Int. Cl.[5] ..... F42B 12/10

[52] U.S. Cl. ..... 102/476; 102/306; 102/501

[58] Field of Search ..... 102/305-310, 102/475, 476, 501

[56] References Cited

U.S. PATENT DOCUMENTS 3,621,916 11/1971 Smith, Jr. ..... 102/306

*Primary Examiner*—Harold J. Tudor

*Attorney, Agent, or Firm*—Toren, McGeady & Associates

[57] ABSTRACT

The invention is directed to a hollow or projectile charge with an explosive material charge (6) and a lining (9) acted upon by the detonation of the explosive material and forming a spike or a projectile (16). In order to achieve the highest possible accelerations for the spike or projectile, the lining (9) is constructed as a part of the hollow space (10) with walls (4, 5) of a good electrically conducting material in which a primarily fed magnetic field (H) is enclosed and compressed by means of the detonation of the explosive material (6). The hollow space (10) is preferably formed by means of a coaxial system (3) of an inner conductor (4) and an outer conductor (5), which coaxial system is short-circuited at both sides, wherein the outer conductor is encased by explosive material (6). During the detonation of the explosive material, the outer conductor (5) is pressed against the inner conductor so that the hollow space (10) located between the outer and inner conductor is constantly reduced.

7 Claims, 5 Drawing Sheets

HOLLOW OR PROJECTILE CHARGE

Figure 1:
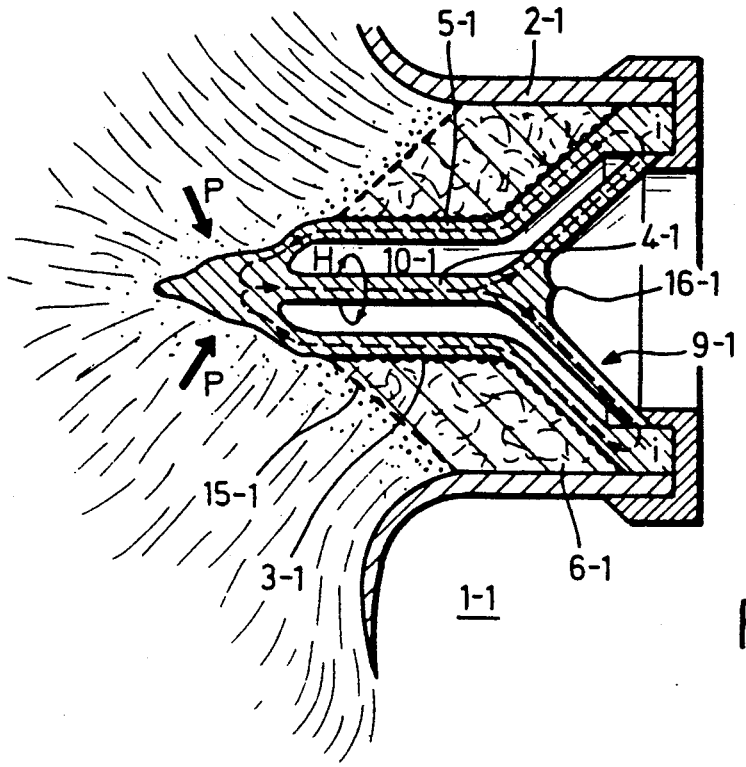

The invention is directed to a hollow or projectile charge with an explosive material charge and a lining acted upon by the detonation of the explosive material charge and forming a spike or projectile.

Such charges have a conically shaped metallic lining which, when the explosive material charge is detonated, is acted upon by gas produced by the explosive material in such a way that the lining deforms and forms a spike or a projectile, respectively, by means of which the penetrating action of the charge is substantially determined. The impetus or momentum transmissible through the lining from the gas produced by the explosive material cannot be increased beyond a maximum in a well dimensioned hollow or projectile charge, e.g., in that one utilizes more explosive material, i.e., a longer "starting run" for the detonation gas. Even in optimally designed charges, only a very small part of the explosive energy is used.

Therefore, the object of the invention is to improve the configuration of hollow or projectile charges in such a way that the final velocities of the spikes or projectiles formed can be substantially increased relative to known charges.

This object is met, according to the invention, by constructing the lining as part of a hollow space using walls of good electrically conducting material in which a primarily fed magnetic field is compressed by detonating the explosive material.

Accordingly, the conventional action of the gas produced by the explosive material upon the lining is combined with the technique of detonative magnetic field compression in order to form the spike or the projectile of the charge. This results in higher spike or projectile velocities, wherein it is possible at the same time to increase the mass of the lining. The explosive energy is stored cumulatively in an increasingly compressed magnetic or electromagnetic field whose pressure, together with the impetus of the explosion gas impacting the compressed hollow space, accelerates the lining over a relatively long distance-time interval. Hereby, better use is made of the explosive energy; as a whole, and the result is a substantially higher velocity of the spike or projectile and accordingly also a substantially higher penetrating effect of the charge than in the conventional charges.

The hollow space compressed by the explosive material is preferably constructed as a coaxial system from an outer and an inner conductor which extend along the charge axis and are formed at the front end of the charge to the lining which, in this case, is double-walled. At the axially opposite end of the coaxial system, a high current pulse is fed between the outer and inner conductor, subsequently, the coaxial system is short-circuited in the vicinity of the electric feed position by means of an annular ignition of the explosive material enclosing the outer conductor. The hollow space between the outer and the inner conductor is thereby closed and compressed in the course of the detonation of the explosive material. In another, connection, magnetic fields of more than 20 mega-gauss are generated by means of such a concentric detonation effect on the coaxial system In hollow or projectile charges, field strengths of approximately 2 mega-gauss can be generated from an initial field of 20 kilogauss with a relatively low expenditure so that the compression factor equals 100. Such a magnetic field undergoes a pressure and energy content increase by the factor of 10,000, so that the field pressure at 2 mega-gauss reaches approximately 160 kilobar and the energy content reaches approximately 16 kilo-joule per cubic centimeter, i.e., approximately twice the energy content of explosive material.

In order to construct a basic magnetic field of 20 kilogauss in an initial volume of, e.g., 1 liter, an electrical energy of 3.2 kilo-joule is required while taking into account approximately 50% losses. This can be supplied by a capacitor bank with 640 $\mu f$ at a voltage of 3.16 kV, which represents a tolerable expenditure.

During the field compression, the occurring pressures act on conducting walls so as to be constantly perpendicular to these walls, which is extremely favorable for a good impetus action on the lining and, accordingly, for the construction of the spike or the projectile. A perpendicular pressure or impetus effect taking place simultaneously over the entire lining surface is a substantial feature of an effectively constructed hollow or projectile charge. The high energy density in connection with the impetus transmission effectiveness of the compressed magnetic field which takes place at the velocity of light makes possible an ideal space-time acceleration characteristic of the lining. The explosion gases impacting on the hollow space at the rear side of the lining later on support the process of deformation of the lining taking place at the front side of the hollow space and, accordingly, make possible a concentric expansion until the spike or projectile formation.

By means of combining the proven explosive material technology and the technique of magnetic field compression, hollow and projectile charges can be produced with a higher spike or projectile velocity and, accordingly, higher penetrating action than was previously possible.

Figure 2:
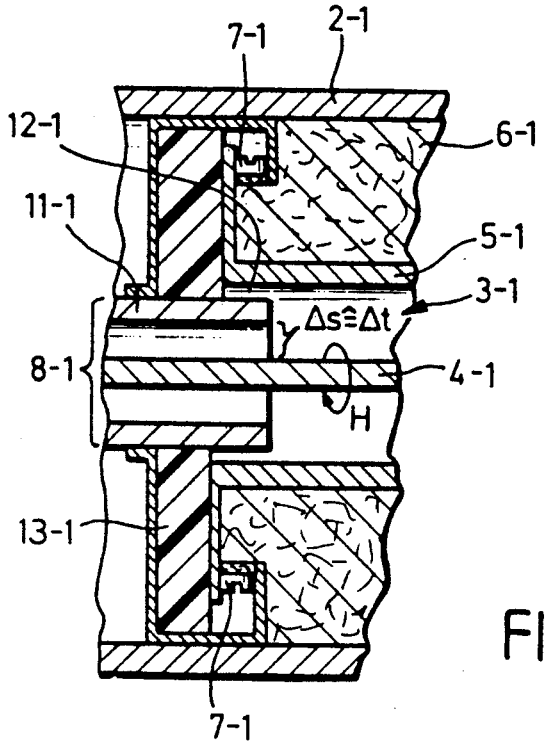
Figure 3:
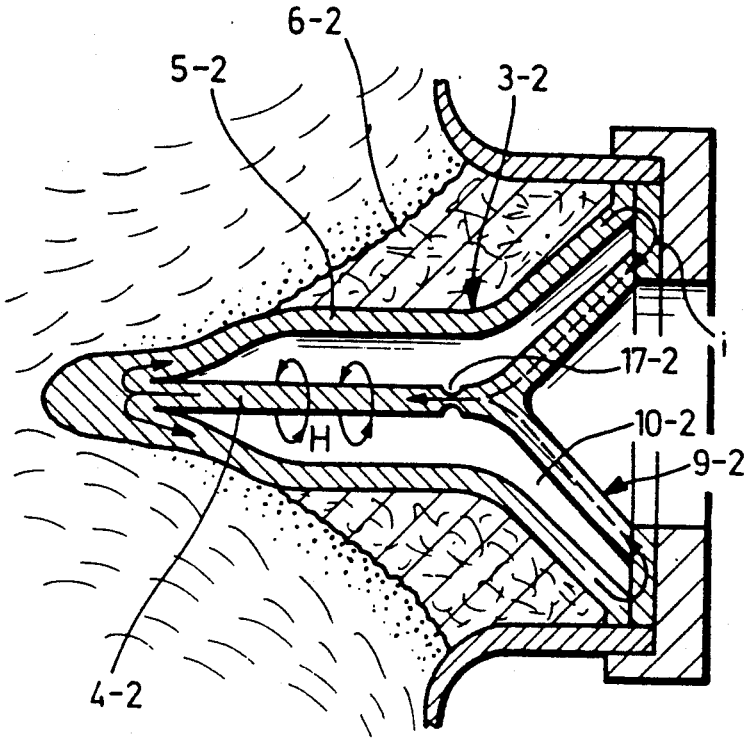
Figure 4:
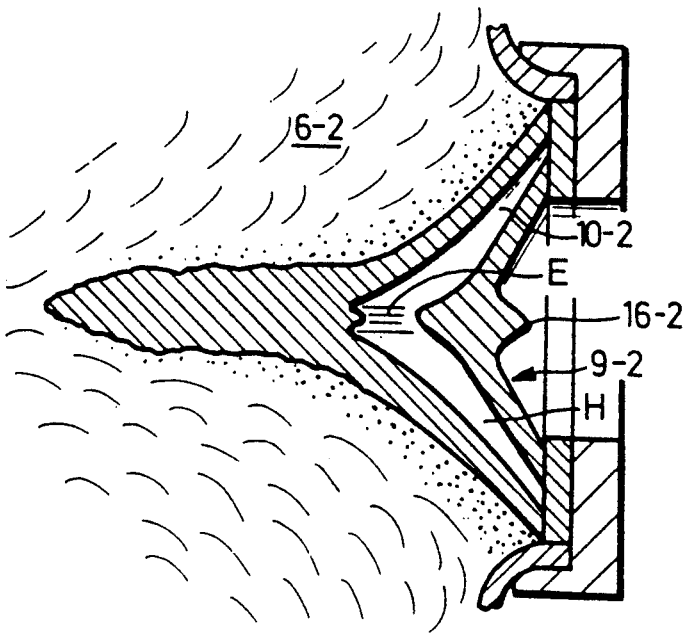
Figure 5:
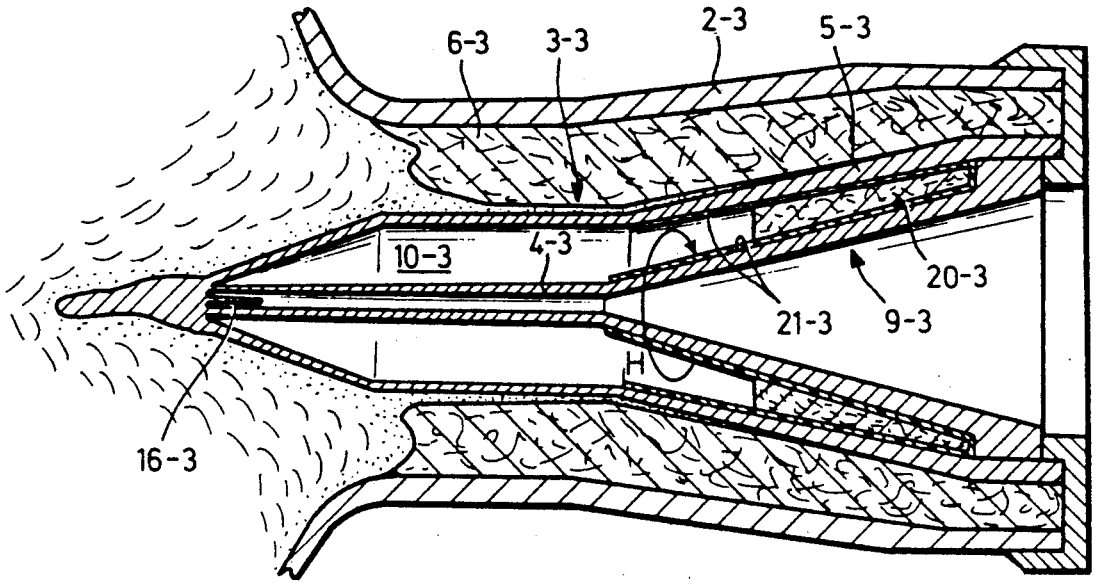
Figure 6:
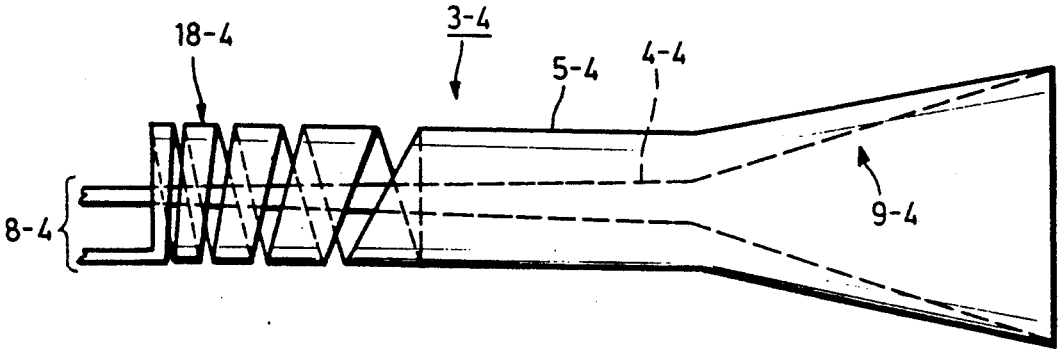

Further constructions of the invention follow from the description in which more detailed embodiment examples for hollow and projectile charges, according to the invention, are discussed with the aid of the drawing. Shown in the drawing are:

FIG. 1—a cross-section through a hollow charge, according to the invention, with magnetic field compression in an advanced state of detonation;

FIG. 2—a part of the hollow charge shown in FIG. 1 before initiating the detonation;

FIG. 3—a further embodiment example of a hollow charge, according to the invention, with magnetic field compression in an advanced state of detonation;

FIG. 4—the hollow charge shown in FIG. 3 shortly before the formation of the hollow charge spike;

FIG. 5—a cross-section through another hollow charge according to the invention;

FIG. 6—a schematic view of a coaxial system for magnetic field compression to be utilized for a hollow charge according to the invention.

Figure 7A:
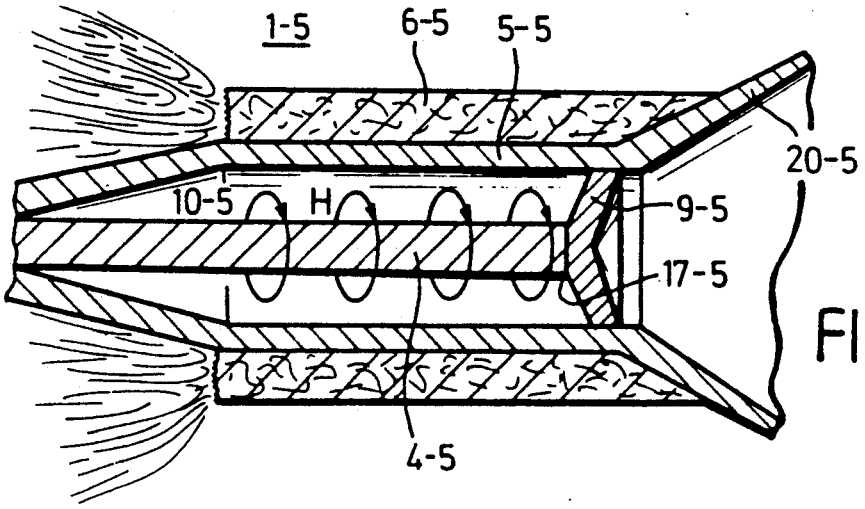
Figure 7B:
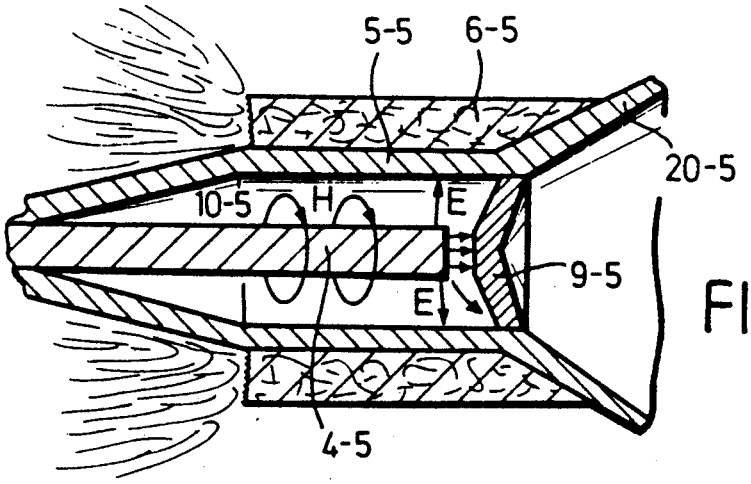
Figure 7C:
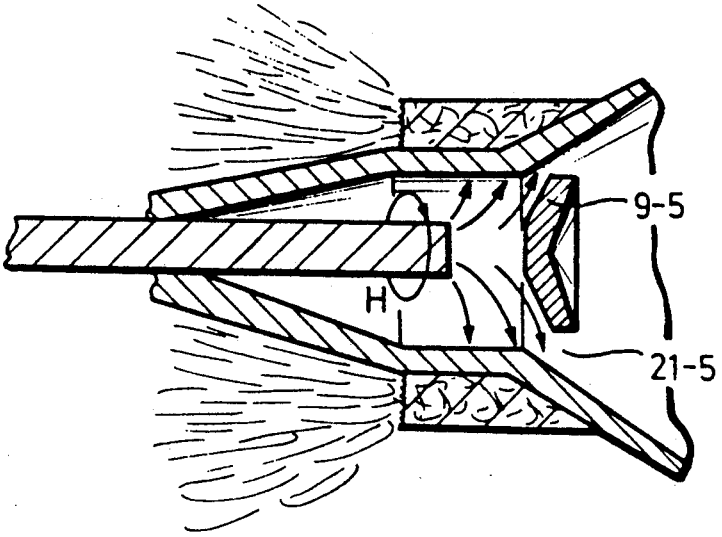
Figure 8A:
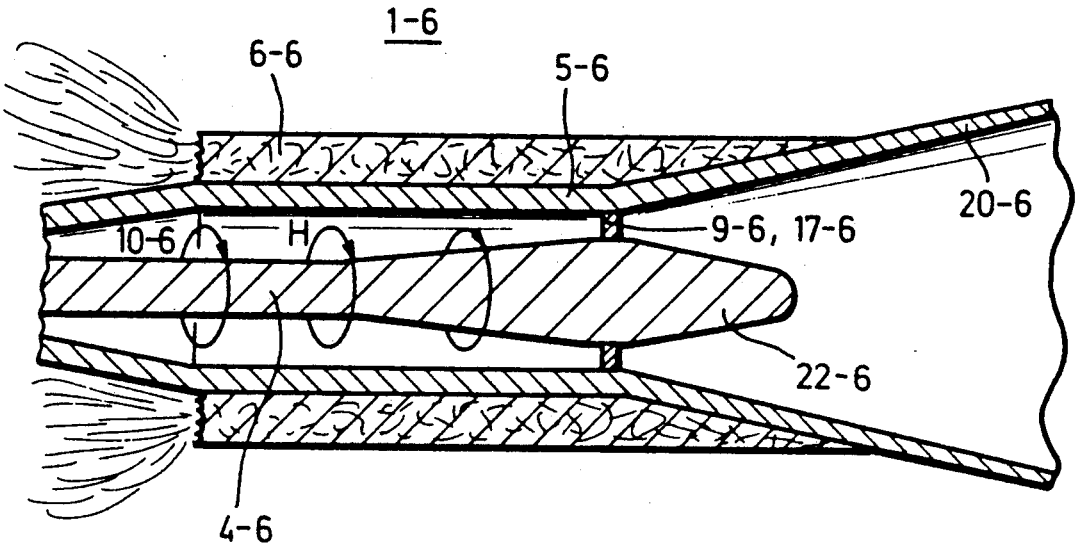
Figure 8B:
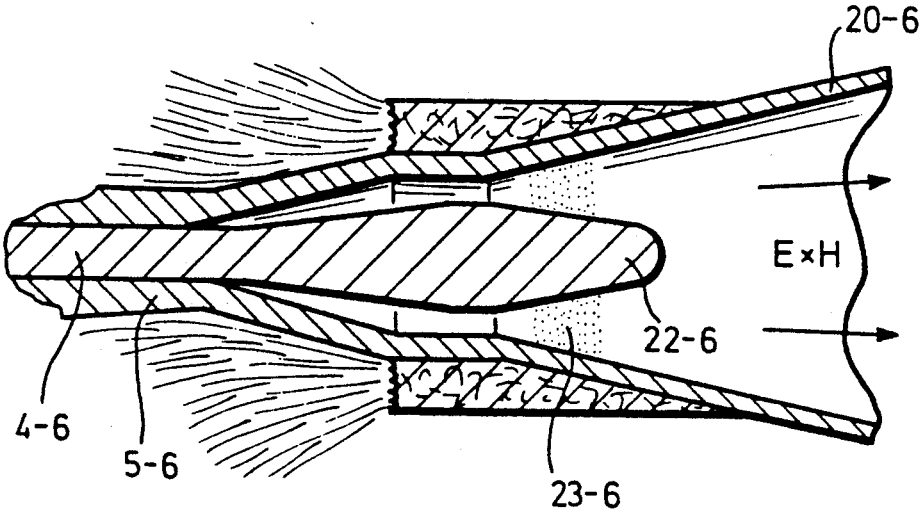

FIGS. 7*a*–7*c*—a further schematic view of a hollow charge in which, in addition, a more strongly directed electromagnetic pulse is radiated, in several detonation states;

FIGS. 8*a* & 8*b*—a schematic cross-section through a further projectile charge for additional radiation of a directed electromagnetic pulse.

The same reference numerals are provided for the same elements in the description, but the number of the embodiment example is placed after them.

A hollow charge 1-1 consists, as follows from FIGS. 1 and 2, of an outer steel jacket 2-1, a centric coaxial system 3-1 with an inner conductor 4-1 and an outer conductor 5-1, an explosive material jacket 6-1 enclosing the outer conductor 5-1, an igniter 7-1 for the explosive material, as well as an electric feed 8-1 for the coaxial system. At the front end of the charge, the explosive material jacket 6-1 is lined with a conical lining 9-1 which is formed by means of widening the outer conductor 5-1 and the inner conductor 4-1 of the coaxial system 3-1. The lining is accordingly double-walled. At the front end of the charge, the two walls of the lining 9-1 are electrically connected with one another. The described coaxial system is a hollow space 10-1 between the inner and outer conductor, which hollow space 10-1 is still open at the location of the electric feed 8-1.

The electric feed 8-1 is effected via a cylinder tube 11-1 enclosing the inner conductor 4-1 of the coaxial system, which cylinder tube 11-1 does not contact the outer conductor 5-1 so that a small surface gap 12-1 remains between the cylinder tube and the outer conductor. The inner conductor 4-1 and the cylinder tube 11-1 are provided with a capacitor bank, (not shown), by means of which a high current pulse is supplied. The charge is closed off towards the rear by means of an insulator 13-1 which encloses the cylinder tube 11-1. Electrically connected with this cylinder tube 11-1 is a bridge wire igniter 7-1 which is installed in the outer area of the explosive material jacket 6-1 and which extends around its entire circumference.

If the hollow charge is to be put into operation, then the capacitor bank is superimposed on the coaxial system. First, only the bridge wire igniter 7-1 is initiated so that the explosive material 6-1 is ignited. When the detonation wave reaches the outer conductor 5-1, then the latter is deformed and is pressed inward in the direction of the cylinder tube 11-1 until it contacts the latter and, accordingly, produces the electric connection between cylinder tube 11-1 and outer conductor 5-1 of the coaxial system 3-1. Now a high current pulse can be fed into the coaxial system 3-1 by means of the capacitor bank. When the detonation of the explosive material 6 advances, the outer conductor 5-1 is pressed in the direction of the inner conductor until it contacts the latter and, accordingly, electrically short-circuits the coaxial system. However, the hollow space 10-1 is also closed by means of this electrical short-circuit. The magnetic field H, fed by means of the high current pulse, is now enclosed in this hollow space 10-1. As indicated in FIG. 1, the detonation of the explosive material continues, wherein the detonation front of the main wave is indicated in dashed lines with 15-1. The front runs so as to be conically inclined forward, since the explosive material was ignited at the outer circumference of the explosive material jacket 6-1. During the forward running of this detonation front, the outer conductor 5-1 of the coaxial system is constantly pressed against the inner conductor so that the closed hollow space 10-1 of the coaxial system is constantly reduced. By means of this reduction, the enclosed magnetic field H is compressed and thereby amplified. Amplification factors up to the factor 100 can be achieved In FIG. 1, the detonation is shown in a far advanced state; the forces acting on the outer conductor are shown by means of the arrows P. In the electrically short-circuited coaxial system 3-1, strong currents i occur which produce a magnetic curl field H running around the inner conductor 4-1. After a certain point in time, a jacket-shaped detonation occurs around the entire rear hollow space, with the exception of the front part constructed as lining 9-1, by means of the pulse-like temperature and pressure load of the explosive material enclosing the coaxial system. This, in connection with the subsequently occurring main detonation front 15-1, provides the necessary support for the lightening-like forming of the lining as hollow charge spike or projectile and its acceleration over the expanding magnetic field. In FIG. 1, a state is shown in which a spike 16-1 begins to form in extension of the inner conductor 4-1.

Particularly reinforcing effects can be achieved by means of a corresponding selection of the materials for the lining and the coaxial system, generally brass or copper, as well as the thicknesses and shapings used. In addition to the above-mentioned annular jacket detonation of the explosive material, such an effect can be, e.g., the intentional interruption of the inner conductor by means of a predetermined weak point. Such an embodiment form is shown in FIGS. 3 and 4.

In the hollow charge according to FIG. 4 the detonation is already so far advanced that the hollow space 10-2 of the coaxial system 3-2 is closed and the magnetic field compression is introduced. The inner conductor 4-2 of the coaxial system has a predetermined weak point 17-2 directly behind the cone tip of the lining 9-2. When the explosive material 6-2 detonates, as in FIG. 3, then the current density in the coaxial system gradually becomes so high that material at the predetermined weak point is evaporated so that the current path previously defined in the electrically short-circuited coaxial system is also interrupted. On the one hand, this interruption has influence on the spike formation and, accordingly, on the shape of the spike and, on the other hand, signifies that the field distribution changes rapidly so that a pulsing electromagnetic field H with rapidly varying vibration or oscillation modes occurs, wherein spark discharges and streams or jets of liquid metal occur at the break point. This state is shown in FIG. 4, wherein there is now a pulsing magnetic field H in the hollow space 10-2, which magnetic field H is enclosed on all sides by the electrically conducting walls of the deformed coaxial system. Due to the laws of induction, however, the dynamics of the magnetic field compression are also continued after the breaking at the predetermined weak point, wherein the current distribution occurring at the inner walls of the hollow space 10-2 forms a complex system of eddy currents repelling one another.

The effect of the conductor constriction which, since it acts in a centering manner on the critical zone of the spike formation, has a positive influence on the formation of a spike 16-2, as in the above embodiment example, until the breaking of the inner conductor 4-2.

After the lining flies away as a spike 16-2 or projectile, the rear part of the hollow space 10-2, i.e., parts of the cylindrical outer conductor 5-2 and of the adjoining rear cone, will also form a second spike or projectile which will be shot after the first spike. The penetrating action is increased hereby as well.

In particular, many possibilities for influencing the spike or projectile shape result by means of the absolutely ensured centering of the lining 9-2 by means of the compressed field, which centering is given until the collapse, i.e., the tearing up of the hollow space. 10-2. FIG. 5 shows a construction of the coaxial system 3-3 with a lining 9-3 with a very acute angle of opening. The inner conductor 4-3 is likewise constructed here as a cylinder tube, e.g., of copper, while the outer conductor 5-3 enclosing the latter is constructed of brass. During the advancing detonation of the explosive material 6-3 and compression of the hollow space 10-3, jets of liquid metal, which then form the spike or projectile in the area of the double-walled lining 9-3, are formed within the inner conductor 4-3. In such an acute-angled lining 9-3, the hollow charge spikes or projectiles produced are very long. Even a "lining" 9-3 which is quasicylindrical at least in the area of the outer conductor 5-3 is conceivable.

Explosive material 20-3 is filled into the hollow space 10-3 between the walls of the double-walled lining 9-3.

FIG. 6 shows a coaxial system 3-4 with several compression stages for the magnetic field. The inner conductor 4-4, which can be constructed as a solid conductor or as a tube, is first enclosed by the outer conductor 5-4 which is wound into a helix 18-4. This helical winding serves to match the impedance at the current source, e.g., the above-mentioned capacitor bank. Next, the outer conductor 5-4 encloses the inner conductor as a cylinder tube as usual. The lining 9-4 is achieved by means of corresponding conical forming of the inner and outer conductors as in the above embodiment examples.

In all the embodiment forms of the coaxial system described above, the material thicknesses can be carried out variably in order to take into account the current densities which are greatly amplified in the course of the compression process. As mentioned above with reference to FIG. 5, the inner conductor can also be constructed as a tube, wherein the wall thickness is then also varied. A particularly long spike starting distance can thereby be achieved.

Of course, other possibilities are also conceivable in order to feed the magnetic field in the hollow space. Thus, e.g., in a coaxial system, a gap can be left open in the outer conductor through which the magnetic field is coupled in the hollow space between the outer and inner conductor. The gap can then be closed, e.g., by means of detonating the explosive material.

It is also possible to partially fill the hollow space with explosive material. This is particularly advantageous in the area of the double-walled lining as indicated in FIG. 5 by 20-3. The hollow space inner walls can also be at least partly covered with an insulating layer 21-3.

In FIGS. 7*a* through *c*, a further construction of a hollow charge 1-5 is shown schematically in various detonation stages. The hollow charge 1-5 again has an inner conductor 4-5, an outer conductor 5-5 coaxially enclosing the latter and an explosive material jacket 6-5 which encloses the outer conductor. The inner conductor 4-5 is connected with a conical electrically conducting hollow space damming 9-5 via a tear-away point 17-5 and extends outwardly to the outer conductor 5-5. The damming 9-5 is axially displaceable in this outer conductor. Adjacent to the hollow space damming, the outer conductor 5-5 is shaped to form a horn antenna 20-5.

In FIG. 7*a*, the detonation of the explosive material jacket 6-5 is so advanced that a closed hollow space 10-5 has already formed between the inner conductor and the outer conductor. The field H is indicated schematically by means of the arrows surrounding the inner conductor 4-5.

When the detonation is advanced further so that the field is highly compressed in the hollow space 10-5 whereby the field pressure on the damming 9-5 tears the tear-away point 17-5, then the damming 9-5 in the outer conductor 5-5 is pushed forward in the direction of the horn antenna 20-5 as is shown in FIG. 7*b*. In this figure, the distribution of the electric field E between the inner conductor and the outer conductor and between the inner conductor and the damming 9-5 is also shown schematically. The hollow space 10-5 is still closed.

When the detonation continues, as shown in FIG. 7*c*, then the damming 9-5 is pushed out of the end of the outer conductor 5-5. An annular gap 21-5, via which the electromagnetic field can exit from the hollow space 10-5, results between the hollow space 10-5 and the space enclosed by the horn antenna 20-5. This electromagnetic field is then coupled in the horn antenna 20-5, wherein the hollow space damming serves as field uncoupling auxiliary means.

According to the construction of the damming 9-5, a spike or a projectile can also be formed here as in the above embodiment examples.

By means of this arrangement, a directed, very strong electromagnetic pulse is radiated through the horn antenna. This electrical pulse serves to electronically disturb possible electronic equipment of the target object, e.g., of an aircraft or tank.

FIGS. 8*a* and 8*b* show another embodiment example for a projectile charge 1-6 in which a strong electromagnetic pulse is likewise radiated in the last phase via a horn antenna 20-6.

The projectile charge 1-6 again consists of an inner conductor 4-6, an outer conductor 5-6 and an explosive material jacket 6-6 enclosing the latter, a well as dammings, not shown here in more detail. The inner conductor is connected with the outer conductor 5-6 via a conducting hollow space damming 9-6, wherein the inner conductor is constructed in the area of this hollow space damming and so as to project out of the latter as an advanced projectile-shaped extension 22-6. The hollow space damming 9-6 is, at the same time, constructed as a weak point 17-6. The outer conductor 5-6 is then constructed at the hollow space damming as the above-mentioned horn antenna 20-6.

In FIG. 8*a*, the detonation is advanced so far that the hollow space 10-6, in which the electromagnetic field is compressed, has already formed between the inner conductor 4-6 and the outer conductor 5-6.

When the electromagnetic field is further compressed in the hollow space 10-6, the current strength in the hollow space damming 9-6, which latter is constructed as a weak point 17-6, becomes so high that the hollow space damming is at least partially vaporized and a metal vapor 23-6 of the hollow space damming, which is vaporized in a quasidetonative manner, occurs in the area of the extension 22-6 between the inner conductor and the outer conductor or the horn antenna 20-6, respectively. Since the metal vapor is a nonconductor, the electromagnetic field can exit from the hollow space 10-6 and is coupled in the horn antenna 20-6. The advanced extension 22-6 of the inner conductor 4-6 serves as a field uncoupling auxiliary means. Among other things, the band width of the radiated electromagnetic pulse can be determined by means of the shape of this extension. The extension itself is spun out as a projectile.

We claim:

1. Hollow or projectile charge comprising an explosive material charge, and a lining acted upon by the detonation of said explosive material charge and forming a spike or projectile, wherein the improvement comprises an axially extending inner conductor (4), an axially extending outer conductor (5) encircling and spaced radially outwardly from said inner conductor, said inner and outer conductors forming a coaxial system (3), said explosive material charge (6) laterally enclosing said outer conductor, said lining comprising a double-walled lining (9) at one end of said inner and outer conductors and comprising a first lining wall (9) extending transversely of and outwardly from the one end of said outer conductor with said first lining wall contacting said explosive material charge, and a second lining wall spaced from said first lining wall and extending transversely of and outwardly from the one end of said inner conductor, said inner and outer conductors and said double-walled lining forming a hollow spaced (10), said coaxial system is electrically open at a location (12) spaced axially from said double-walled lining, electric feed means (8) in spaced relation to said inner and outer conductors at the electrically open location for feeding a high current pulse into said coaxial system so that an electromagnetic field is generated in said hollow space (10), an igniter (7) located in said explosive material charge in the region of the electrically open location (12) and the ignition thereof is initiated after feeding the high current pulse whereby the inner and outer conductors are pressed into contacts closing said hollow space (10), and the detonation of the explosive material charge continues to compress said hollow space until the spike is formed from said double-walled lining (9).

2. Charge according to claim 1, wherein said inner conductor (4-2) has a predetermined weak point (17-2) directly at the one end at the transition into said lining (9-2).

3. Charge according to claim 1, wherein said inner conductor is a tube.

4. Charge according to claim 1, wherein the explosive material charge (6-1) is a jacket enclosing said outer conductor (5-1) and is provided in the vicinity of said electrical feed means (8-1) with said igniter (7) extending around the entire circumference of said jacket.

5. Charge according to claim 1, wherein said outer conductor (5-4) is helically wound at least partially around said inner conductor (4-4).

6. Charge according to claim 1, wherein parts of said hollow space (10) between said double-walled lining are filled with said explosive material (20-3).

7. Charge according to claim 6, wherein that the hollow space inner walls are coated at least partly with an electrically insulating material (21-3).

* * * * *